United States Patent [19]

Goldbach et al.

[11] Patent Number: 4,693,262

[45] Date of Patent: Sep. 15, 1987

[54] APPARATUS FOR FORMING BATCHES OF TOBACCO AND THE LIKE

[75] Inventors: Manfred Goldbach, Hamburg; Siegfrid Marquardt, Westerau; Jochim Myohl, Wentorf, all of Fed. Rep. of Germany

[73] Assignee: Hauni-Werke Körber & Co. KG, Hamburg, Fed. Rep. of Germany

[21] Appl. No.: 836,527

[22] Filed: Mar. 5, 1986

[30] Foreign Application Priority Data

Mar. 9, 1985 [DE] Fed. Rep. of Germany ..... 3508499

[51] Int. Cl.[4] ..... A24C 5/18; A24C 5/25; A24C 5/34; A24C 5/39

[52] U.S. Cl. ..... 131/84.3; 131/84.1; 131/84.4; 131/110

[58] Field of Search ..... 131/84.1, 84.3, 84.4, 131/108, 110, 282, 61.1

[56] References Cited

U.S. PATENT DOCUMENTS

| | | | |
|---|---|---|---|
| 3,795,249 | 3/1974 | Cristiani | 131/84.4 |
| 3,854,486 | 12/1974 | Molins et al. | 131/84.4 |
| 3,854,487 | 12/1974 | Molins et al. | 131/61.1 |
| 4,009,722 | 3/1977 | Wahle et al. | 131/84.4 |
| 4,373,538 | 2/1983 | Steiniger | 131/108 |
| 4,485,826 | 12/1984 | Holzangel | 131/84.4 |
| 4,516,585 | 5/1985 | Pinkham | 131/84.4 |
| 4,556,071 | 12/1985 | Hoffmann | 131/84.4 |
| 4,564,028 | 1/1986 | Heitmann | 131/84.4 |
| 4,605,013 | 8/1986 | Goldbach | 131/108 |
| 4,616,662 | 10/1986 | Hartmann et al. | 131/84.1 |

*Primary Examiner*—V. Millin
*Assistant Examiner*—H. Macey
*Attorney, Agent, or Firm*—Peter K. Kontler

[57] ABSTRACT

Apparatus for forming a composite filler which is to be draped into a web of cigarette paper has a rotary wheel-shaped conveyor with a series of pockets which are provided in its peripheral surface and are connected to a suction generating device which draws into the pockets shreds of tobacco or other smokable fibrous material issuing from the outlet of a pneumatic conduit which receives metered quantities of fibrous material from a belt conveyor. The inclination of the stream issuing from the outlet with reference to the peripheral surface of the rotary conveyor is such that fibrous material which advances from the outlet toward and into successive pockets has a component of movement in the direction of rotation of the rotary conveyor, i.e., the particles of fibrous material do not travel radially of the rotary conveyor. The pockets are connected to the suction generating device before they reach the locus of impingement of fibrous material so that they can deflect the leader of the stream of admitted fibrous material counter to the direction of rotation of the rotary conveyor. The admission of fibrous material into the pockets can be promoted by appropriate inclination of surfaces at the front and rear ends of the pockets as well as by regulating the pressure in the pockets.

29 Claims, 12 Drawing Figures

APPARATUS FOR FORMING BATCHES OF TOBACCO AND THE LIKE

CROSS-REFERENCE TO RELATED CASES

The apparatus of the present invention is identical with the apparatus which are disclosed in the commonly, owned copending patent applications Ser. Nos. 06/836,387 and 06/836,313 both filed Mar. 5, 1986.

The apparatus of the present invention constitutes an improvement over and a further development of apparatus which are disclosed in numerous pending United States and other applications and granted United States and other patents of the assignee. Reference may be had to United States patent applications Ser. Nos. 557,641 (filed Dec. 2, 1983 by Heitmann) and 557,733 (filed Dec. 2, 1983 by Wahle et al.) and to U.S. Pats. Nos. 4,463,768 to Quarella, 4,564,026 to Wahle et al., 4,564,027 to Heitmann, and 4,485,826 to Holznagel.

BACKGROUND OF THE INVENTION

The present invention relates to apparatus for accumulating fibrous materials, especially particles of tobacco leaves, into arrays in the form of batches or the like. More particularly, the invention relates to improvements in apparatus for accumulating or forming batches of tobacco shreds or like fibrous materials preparatory to conversion of batches and of additional fibrous material into the filler of a rod of smokable material. Still more particularly, the invention relates to improvements in apparatus of the type wherein batches are formed by admitting fibers into successive pockets which are machined into or are otherwise formed in the peripheral surface of a rotary conveyor.

Commonly owned U.S. Pat. No. 4,009,722 to Wahle et al. discloses an apparatus wherein batches consisting of first fibers are accumulated in the pockets of a rotary conveyor by showering first fibers onto the conveyor and by evacuating air from the pockets during travel below the shower. The batches are transferred onto a second conveyor and the gaps between neighboring batches are filled with second fibers to form a composite stream which is thereupon converted into the filler of a cigarette rod. The second conveyor attracts the batches and the second fibers by suction. It has been found that showering of tobacco particles or like fibrous materials into the orbiting pockets in the periphery of a rotary wheel-shaped conveyor does not invariably ensure the accumulation of batches having a predictable homogeneousness, density and/or other desirable parameters. The situation is aggravated if the rotary conveyor is driven at a high speed as is required in a modern cigarette making plant.

German Offenlegungsschrift No. 34 01 372 discloses means for pneumatically transporting a narrow stream of fibrous material toward the path of orbiting pockets on the rotary wheel-shaped conveyor. The leader of the stream extends radially of the conveyor and its particles are attracted into the oncoming pockets by suction. This proposal renders it possible to enhance the homogeneousness and density of the batches; however, it still fails to provide a solution which ensures the making of satisfactory batches when the wheelshaped conveyor is driven at a high RPM. Therefore, there exists an urgent need to provide an apparatus which can reliably form a succession of batches from fragmentized tobacco leaves or from other fibrous materials of the tobacco processing industry at any desired practical frequency and in such a way that the quality of the batches does not decrease, or does not decrease appreciably, in response to an increase of rotational speed of the conveyor.

OBJECTS AND SUMMARY OF THE INVENTION

An object of the invention is to provide a novel and improved apparatus which renders it possible to turn out homogeneous batches of fragmentized tobacco particles or other smokable fibrous materials at a frequency which is desired and necessary in a modern cigarette making or like plant.

Another object of the invention is to provide an apparatus which is capable of turning out homogeneous and identical batches of comminuted tobacco leaves, fragmentized sheets of reconstituted tobacco and/or substitute tobacco at a frequency which cannot be achieved in heretofore known apparatus.

A further object of the invention is to provide the apparatus with novel and improved means for supplying or feeding fibrous material to the pockets of the rotary conveyor.

An additional object of the invention is to provide the apparatus with novel and improved means for automatically adjusting one or more units when one or more parameters of the batches deviate from desired values.

Still another object of the invention is to provide the apparatus with novel and improved means for collecting and reusing the non-accepted fibers.

A further object of the invention is to provide the apparatus with novel and improved means for ensuring predictable penetration of fibrous material into the pockets of the rotary conveyor.

An additional object of the invention is to provide the apparatus with novel and improved means for manipulating the batches upon exupulsion from the pockets of the rotary conveyor.

A further object of the invention is to provide novel and improved means for equalizing the batches in the pockets of the rotary conveyor.

Still another object of the invention is to provide the apparatus with novel and improved means for guiding a mass of fibrous material on its way toward and into successive pockets of the rotary conveyor.

The invention resides in the provision of an apparatus for forming batches from fibers of the tobacco processing industry, especially from particles of tobacco leaves. The apparatus comprises a pneumatic conduit having an outlet, a source of fibers, means for supplying from the source to the conduit a continuous narrow stream of fibers so that the stream advances toward, through and beyond the outlet, and means for converting at least a portion of the stream into a series of batches in a region adjacent to the outlet. The converting means comprises a rotary conveyor having a peripheral surface which is provided with a succession of pockets in the form of recesses and means for evacuating air from the pockets. The outlet is positioned to deliver at least the major portion of the stream to successive pockets of the rotary conveyor with a component of movement in the direction of rotation of the rotary conveyor so that fibers which enter the pockets accumulate into discrete batches.

The outlet of the conduit is spaced apart from the peripheral surface of the rotary conveyor, and the apparatus further comprises guide means for guiding the stream between the outlet and the peripheral surface of the rotary conveyor in a direction intermediate a radial and a tangential direction with reference to the periphal surface of the rotary conveyor. The guide means includes a section which is spaced apart from the peripheral surface of the rotary conveyor, and the evacuating means is preferably effective to evacuate air from successive pockets already upstream of the just mentioned section of the guide means, as considered in the direction of rotation of the rotary conveyor, so that the leader of the stream which advances beyond the section of the guide means is caused to move counter to the direction of rotation of the rotary conveyor and to enter the oncoming pocket in the peripheral surface. Such deflection of leader of the stream ensures a more reliable and more predictable filling of successive pockets with fibers. The apparatus preferably further comprises means for adjusting the position of the aforementioned section of the guide means with reference to the rotary conveyor.

The pockets are normally arranged to accept a portion of the stream which issues from the outlet of the conduit, and the apparatus further comprises means for collecting the non-accepted portion of the stream and means for advancing the batches which are formed in the pockets away from the rotary conveyor along a predetermined path. The collecting means can comprise a second conduit having an intake end in the region of the outlet of the first mentioned conduit and a discharge end, and a suction generating device (such suction generating device can constitute the fan of a cyclone separator wherein a gaseous carrier medium for the fibers is segregated from the surplus of fibers) which is connected to the discharge end of the second conduit.

Each pocket can have at least one portion of greater depth and at least one portion of lesser depth. The portion of greater depth is preferably located substantially midway between the ends of the respective pocket, as considered in the circumferential direction of the rotary conveyor.

The rotary conveyor can be provided with pairs of mutually inclined surfaces which flank the pockets in its peripheral surface. The surfaces of each pair are disposed at the upstream and downstream ends of the respective pocket, as considered in the direction of rotation of the rotary conveyor. The inclination of surfaces which flank the pockets is preferably selected in such a way that the fibers encounter little resistance during penetration into the oncoming evacuated pockets.

The outlet of the conduit which supplies the stream of fibers is disposed at a first station, and the means for receiving batches from successive pockets of the rotary conveyor is disposed at a second station which is located downstream of the first station, as considered in the direction of rotation of the rotary conveyor. The apparatus preferably further comprises means for admitting streams of compressed air into successive pockets downstream of the second station but upstream of the first station so as to expel remnants of fibers from the pockets which are on their way toward the outlet of the stream-supplying conduit.

As a rule, the pockets receive only a portion of the stream, and some of the fibers are also separated from the batches during evacuation of batches from the respective pockets. Therefore, the apparatus preferably further comprises means for returning separated fibers into the stream-supplying conduit and for returning the fibers of the non-accepted portion of the stream to the source of fibers.

The apparatus preferably further comprises means for trimming the batches in the pockets downstream of the outlet of the stream-supplying conduit, as considered in the direction of rotation of the rotary conveyor. Such trimming means can comprise a fixedly mounted knife which is adjacent to the path of orbital movement of the pockets and a rotary knife having cutting edges which cooperate with the fixedly mounted knife to shear the surplus of fibers from the batches in successive pockets. The cutting edges of the rotary knife are preferably inclined with reference to the axis of the rotary conveyor.

The apparatus preferably further comprises adjustable means for influencing a parameter of the batches (for example, the density of the batches), signal generating means for monitoring the parameter of the batches, and means for adjusting the influencing means in response to signals from the monitoring means when the monitored parameter deviates from a predetermined value. For example, signals from the monitoring means can be utilized to adjust the evacuating means (i.e., to alter the pressure in the pockets which approach the outlet of the stream-supplying conduit) in response to signals from the monitoring means when the monitored parameter deviates from the predetermined value. In addition to or in lieu of such adjustment of the evacuating means, signals from the monitoring means can be utilized to adjust the means for supplying fibers to the streamsupplying conduit when the monitored parameter of batches deviates from a predetermined value. Still further, signals from the monitoring means can be utilized to adjust the aforementioned trimming means for batches in successive pockets of the rotary conveyor. The signals from the monitoring means can also be utilized to adjust the aforementioned guide means which guides the stream intermediate the outlet of the streamsupplying conduit and the peripheral surface of the rotary conveyor when the monitored parameter of batches deviates from a predetermined value.

The means for supplying fibers to the streamsupplying conduit can comprise a second conveyor (preferably an air-permeable belt conveyor) which serves to deliver into the stream-supplying conduit metered quantities of fibers per unit of time. Such supplying means can further comprise means for transferring fibers from the source onto the second conveyor so as to form the aforementioned narrow stream. The transferring means can include means for showering fibers onto the second conveyor in a direction transversely of the direction of travel of the stream with the second conveyor. The supplying means can further comprise adjustable trimming means for equalizing the stream on the second conveyor.

The apparatus preferably further comprises an endless belt conveyor or other suitable means for advancing batches from successive pockets along a predetermined path wherein the batches form a file with gaps between successive batches of the file, means for admitting second fibers into the gaps so as to form on the advancing means a composite stream wherein the batches alternate with accumulations of second fibers, and means for homogenizing the composite stream, at least in the regions where the batches abut the accumulations of second fibers. The homogenizing means can comprise means for compacting or condensing the composite stream in the aforementioned regions. Such apparatus preferably further comprises means for equalizing the homogenized composite stream. Alternatively, the apparatus can comprise combined homogenizing and equalizing means for the composite stream. Such combined homogenizing and equalizing means can comprise a rotary trimming device having pockets or other suitable means for leaving on the composite stream a protuberance in each of the aforementioned regions, and means for draping the trimmed composite stream into a web of wrapping material so as to form a rod wherein the composite stream constitutes a rod-shaped filler which is devoid of protuberances and is surrounded by a tubular body of wrapping material.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2*a* is an enlarged partly sectional view of a detail in the structure of FIG. 2;

DESCRIPTION OF THE PREFERRED EMBODIMENTS

Figure 1:
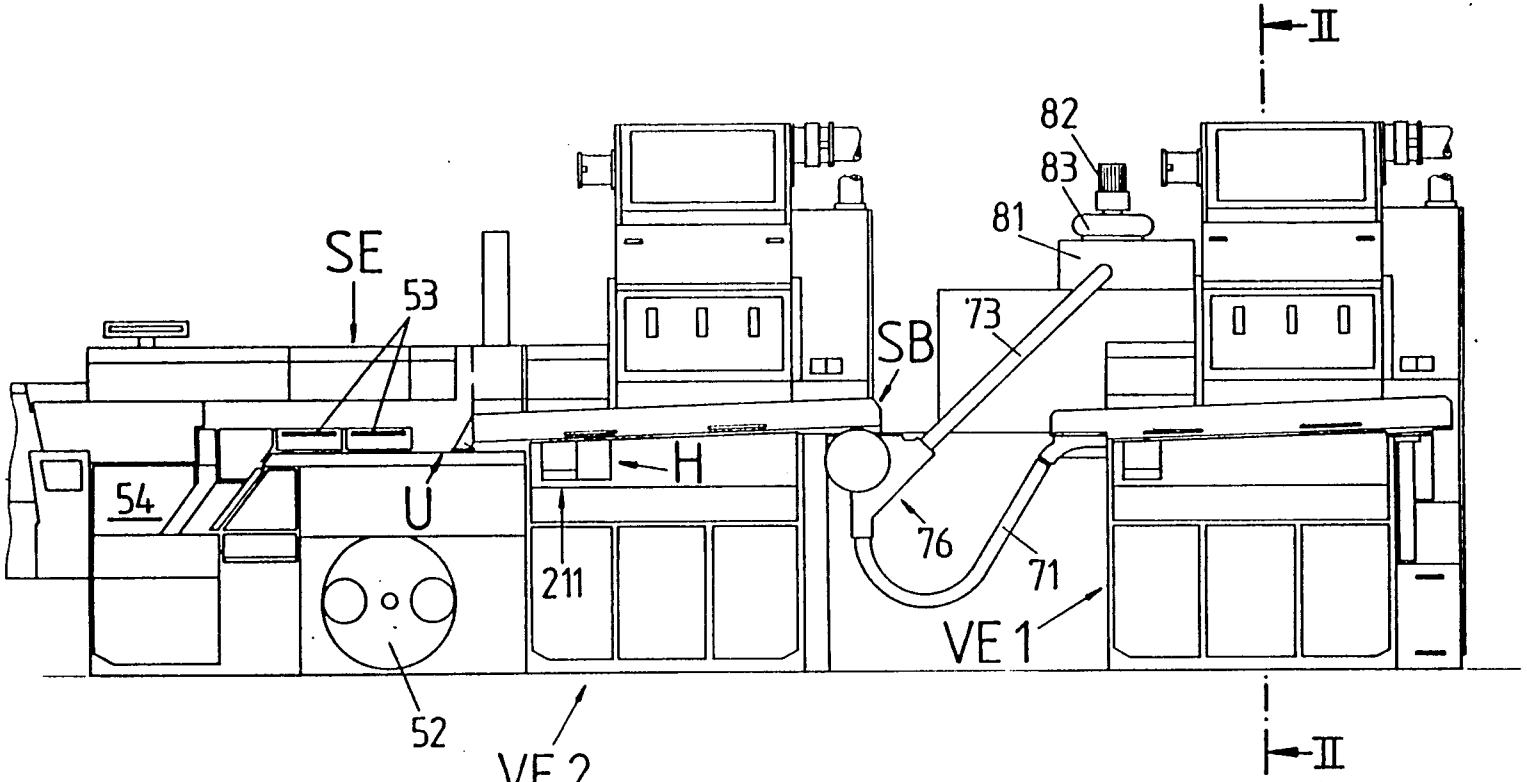
FIG. 1 is a schematic elevational view of a cigarette making machine which embodies or constitutes the improved apparatus and is designed to turn out plain cigarettes each of which contains two types of smokable fibrous material.
Figure 2:
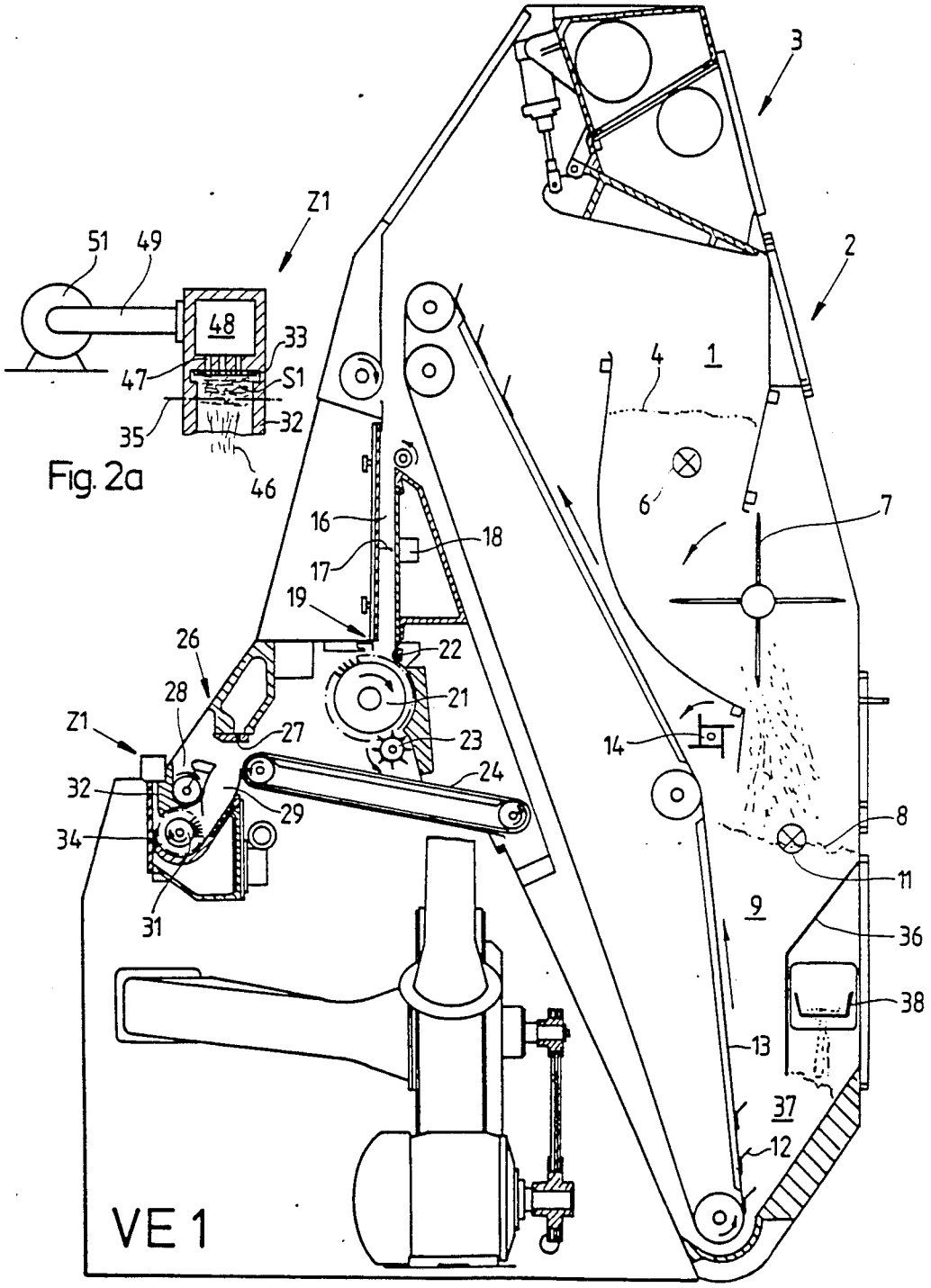
FIG. 2 is an enlarged transverse vertical sectional view as seen in the direction of arrows from the line II—II of FIG. 1.
Figure 3A:
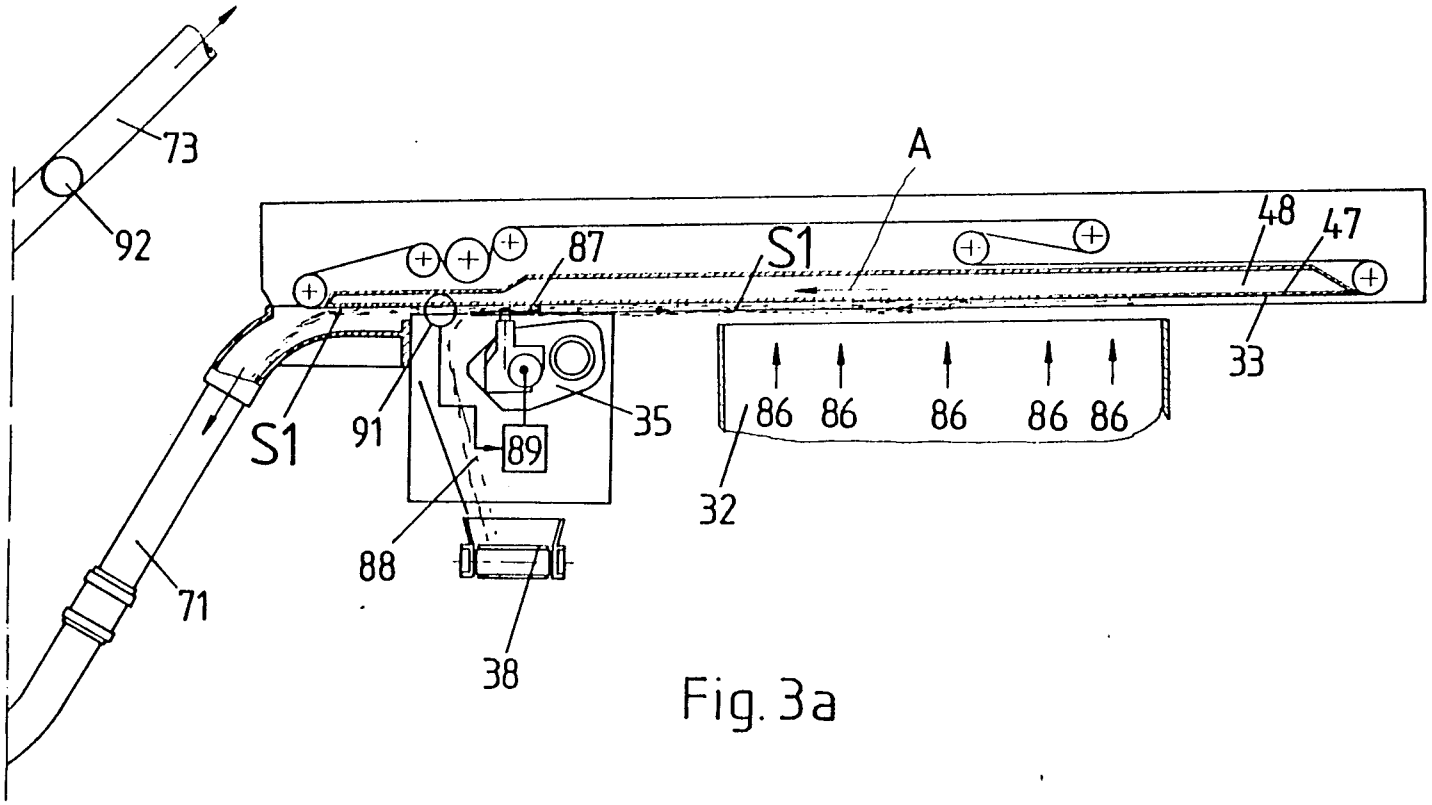
FIG. 3*a* is an enlarged partly elevational and partly longitudinal vertical sectional view of means for gathering first fibrous material into a narrow stream which is advanced to the batch forming station.
Figure 3B:
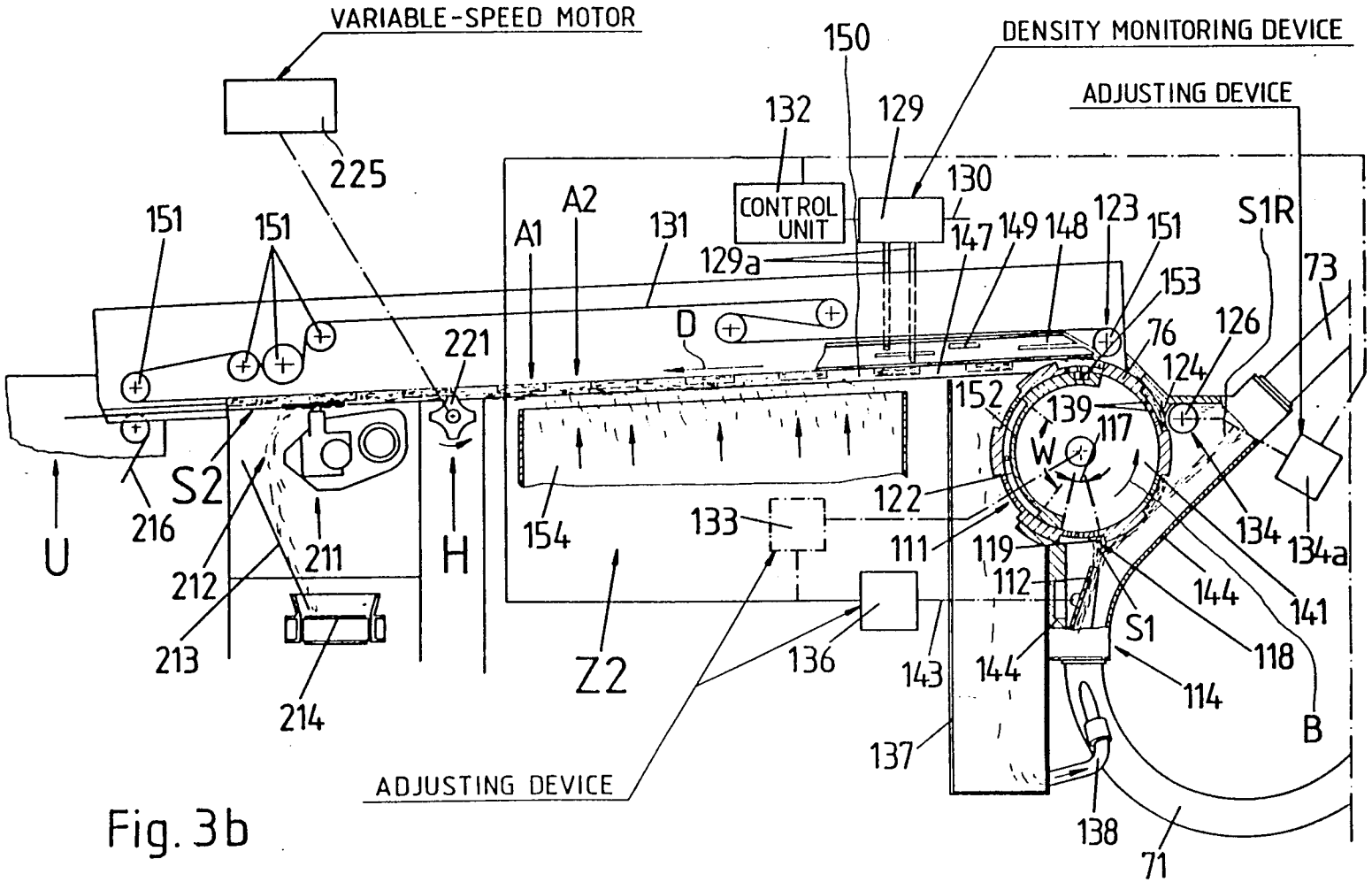
FIG. 3*b* is an enlarged vertical sectional view of the rotary stream converting conveyor at the batch forming station and a partly elevational and a partly longitudinal vertical sectional view of means for assembling batches of first fibrous material and accumulations of second fibrous material into a composite stream.
Figure 6:
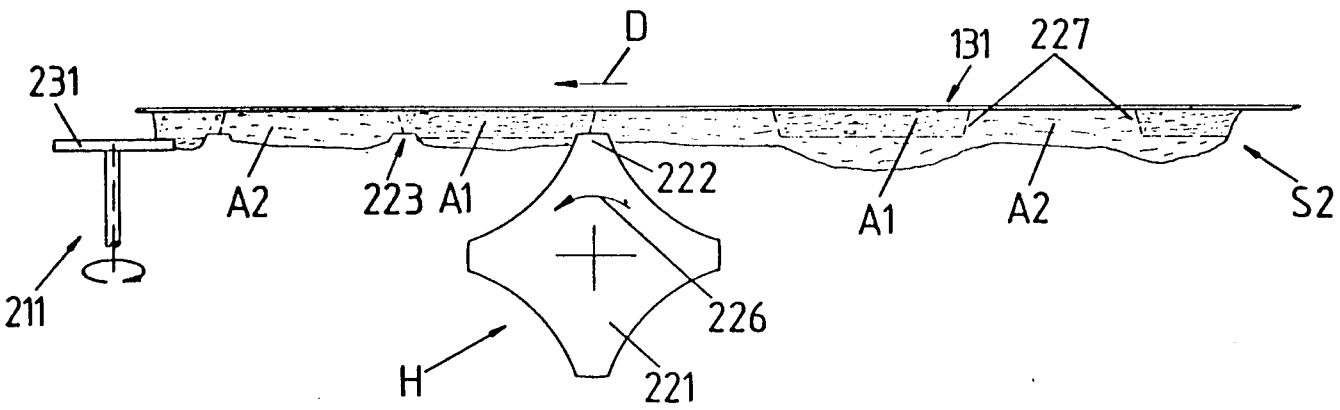
FIG. 6 illustrates a portion of the structure which is shown in FIG. 3*b* with a first embodiment of homogenizing means for the composite stream.
Figure 7:
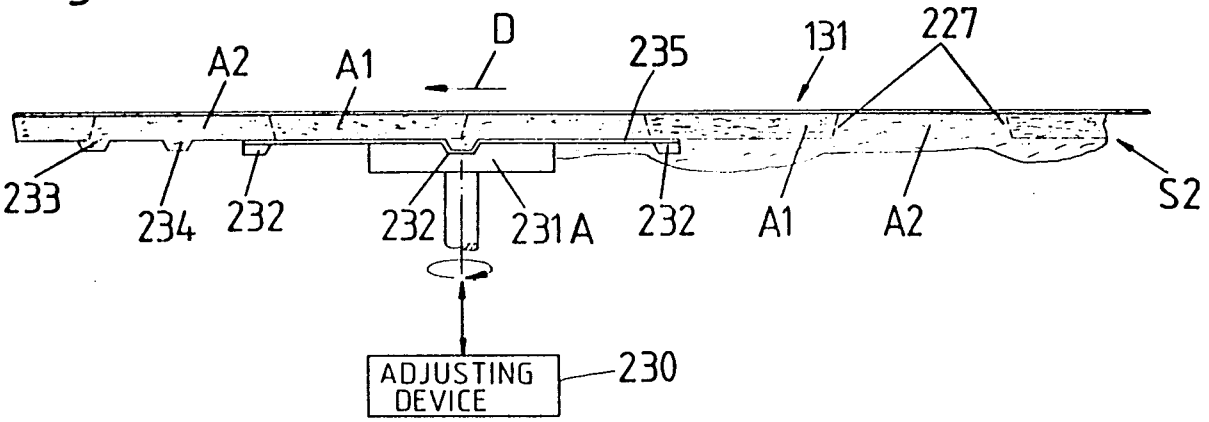
FIG. 7 illustrates the structure of FIG. 6 but with modified homogenizing means.

FIG. 1 shows schematically a cigarette rod making machine which converts a narrow stream S1 (FIGS. 2, 3*a*, 3*b*) consisting of a first type of tobacco particles (e.g., shreds or otherwise comminuted portions of tobacco leaves) into a series of batches A1 (FIGS. 3*b*, 6, 7) which, in turn, are combined with accumulations A2 (FIGS. 3*b*, 6, 7) consisting of a different second type of tobacco particles to form a composite stream S2 (FIGS. 3*b*, 6, 7). The composite stream S2 is thereupon homogenized and equalized prior to conversion into a continuous rod-like filler which is simultaneously draped into a web (216 in FIG. 3*b*) of cigarette paper or other suitable wrapping material, and the resulting continuous cigarette rod is ultimately subdivided in a conventional cutoff 54 (FIG. 1) to yield a succession of discrete rod-shaped articles or sections in the form of plain cigarettes of unit length or multiple unit length. The purpose of the machine which is shown in FIG. 1 and of the improved apparatus which is embodied in such machine is to produce rod-shaped smokers' articles each of which contains a tubular wrapper of cigarette paper or the like surrounding a rod-like filler of fibrous material, namely a filler having at least one first portion consisting of a first fibrous material and at least one second portion consisting of a different second fibrous material. The details of those portions or units of the apparatus which cannot be readily seen in FIG. 1 and/or which are shown in FIG. 1 on a relatively small scale are illustrated in FIGS. 2, 2*a*, 3*a*, 3*b*, 4, 4*a*, 4*b*, 4*c*, 5, 6 and 7.

The reference character VE1 designates in FIG. 1 that part of the improved apparatus (the terms apparatus and machine will be used interchangeably) which serves to form the narrow first stream S1, to recover that portion (remnant) of the first stream (shown at S1R in FIG. 3*b*) which is not accepted for conversion into batches A1, and to deliver successive increments of the first stream S1 to a wheel-shaped rotary conveyor 76 which constitutes a continuously circulating means for converting at least the major portion of the stream S1 into a succession of discrete batches A1 having at least substantially identical sizes and shapes. The part VE1 includes a pneumatic conduit or conveyor 71 which defines a predetermined portion of the path for travel of the stream S1 toward a batch forming station 118 (FIG. 3*b*) where the stream is converted into a series of batches A1. The conduit 71 confines the stream S1 from all sides on the way from the underside of the lower reach of an air-permeable endless belt conveyor 33 (FIGS. 2*a*, 3*a*) which defines a second portion of the path for the stream S1 and receives a narrow shower 46 (FIG. 2*a*) of tobacco particles of the first type from a duct 32 (FIGS. 2, 2*a* and 3*a*) forming part of a means for transferring particles of the first type from a relatively small supply 8 in a magazine 9 or an analogous source (FIG. 2) to the underside of the lower reach of the conveyor 33. A second pneumatic conduit 73 of the part VE1 serves to transport (preferably by suction) the non-accepted portion or remnant S1R of the stream S1 back toward the magazine 9 and preferably into the lower portion 37 of the magazine at a level below the supply 8 of first fibrous material. The means for drawing the gaseous carrier medium (preferably air) through the conduits 71 and 73 (i.e., into the inlet of the conduit 71 adjacent to the discharge end of the belt conveyor 33, toward and through the outlet 114 (FIGS. 3*b*, 4, 4*a*) of the conduit 71 and thereupon into the intake end and toward and beyond the discharge end of the conduit 73) comprises a fan or another suitable suction generator 83 forming part of a cyclone separator 81 mounted on the housing of the part VE1 and serving to segregate the gaseous carrier medium from the particles of the stream portion or remnant S1R. The exact construction of the cyclone separator 81 forms no part of the present invention; FIG. 1 merely shows the aforementioned fan 83 and a motor 82 which drives the fan so as to draw the gaseous carrier medium into the intake end and toward and out of the discharge end of the conduit 73. The segregated fibrous material is returned into the magazine 9 in a manner which is not specifically shown in the drawing. If the stream S1 is advanced by a compressed gaseous carrier medium, the cyclone separator can be replaced with a simple air lock having a set of rotary vanes of the type often used in tobacco processing machines. The casing of the cyclone separator 81 preferably confines a suitable curved guide surface which effects a reliable segregation of fibrous material from the gaseous carrier medium. The gate which discharges segregated fibrous material from the casing of the cyclone separator 81 is not shown in FIG. 1.

The conveyor 76 delivers a succession of batches A1 to a stream forming unit SB whose construction is shown in FIG. 3*b* and which serves to assemble accumulations A2 in the gaps 147 between successive batches A1 in an elongated path which is defined by the underside of the lower reach of an endless foraminous belt conveyor 131 serving as a means for advancing the thus obtained composite stream S2 in the direction of arrow D.

The accumulations A2 are formed from fibrous material of a second type which is admitted or introduced into the stream forming unit SB by a duct 154 forming one element of a part VE2 which is or can be analogous to the part VE1 and ensures that the duct 154 receives a uniform stream of fibrous material from a second magazine or other suitable source (not specifically shown). This ensures a predictable formation of accumulations A2 and hence the formation of a satisfactory composite stream S2 which can be converted into a high-quality rod-like filler for wrapping into the web 216 in a draping device U ahead of the cutoff 54. An adjustable trimming or equalizing device 211 (FIGS. 1, 3*b* and 6) is provided to equalize the composite stream S2 upstream of the draping device U. The arrangement is preferably such that the equalizing device 211 preferably removes only second fibrous material (which is delivered via duct 154 and is used to form the accumulations A2); this is desirable and advantageous because the material which is removed by the equalizing device 211 contains a single type of fibers and can be returned directly into the magazine of the part VE2.

The apparatus of FIG. 1 further comprises a homogenizing device H which is shown in greater detail in FIGS. 3*b* and 6 and whose function is to uniformize the composite stream S2 in regions (see the regions 227 in FIG. 6) where the ends of the batches A1 abut the neighboring accumulations A2. The homogenizing device H of FIGS. 1, 3*b* and 6 is designed to influence the density of the stream S2 in the regions 227 as well as to shift or displace certain portions of the accumulations A2 in a direction toward the underside of the lower reach of the belt conveyor 131 i.e., toward the means for advancing the stream S2 from a transfer station 123 where the conveyor 131 receives a file of spaced-apart batches A1 from the conveyor 76 toward and past the equalizing device 211 and into the draping device U.

The draping device U and the cutoff 54 can be said to constitute a cigarette rod forming and subdividing unit SE which follows the stream forming unit SB and can be disposed at the cigarette receiving end of a filter tipping machine, wherein plain cigarettes are converted into filter cigarettes, or at the receiving end of a packing machine for plain cigarettes. The draping device U can be of conventional design, e.g., it can comprise or constitute a so-called format wherein the filler is draped into the web 216 with simultaneous densification and conversion into a rod-shaped body having a circular or substantially circular cross-sectional outline. The web 216 is drawn off a reel 52 which is mounted on the frame of the apparatus at a level below the draping device U and must be replaced at required intervals to ensure continuous delivery of a web of cigarette paper or the like into the format of the device U. The manner in which one marginal portion of the web 216 is coated with adhesive in a paster to form with the other marginal portion an elongated seam extending longitudinally of the cigarette rod is well known. FIG. 1 further shows a tandem sealer 53 which heats the seam in order to effect rapid setting of the adhesive and to thus reduce the danger of opening the freshly formed seam during travel through the cutoff 54. The latter has one or more knives which cut the cigarette rod across the batches A1 and/or across the accumulations A2, depending on the length of the rod-shaped sections which issue from the cutoff 54.

The part VE2, the rod forming and subdividing unit SE and the equalizing device 211 are or can be identical with the corresponding units of a cigarette making machine known as PROTOS which is manufactured and sold by the assignee of the present application.

Fibrous material which is stored in the magazine 9 to form the supply 8 is a smokable material which can consist of particles of natural tobacco leaves, comminuted sheets of reconstituted tobacco and/or fragments of substitute tobacco (e.g., cellulose). The same applies for the fibrous material in the magazine of the part VE2. For example, the particles of first fibrous material can consist of aromatic tobacco with a high or low nicotine content; alternatively, such particles can consist of mild-taste tobacco having a high or low nicotine content. The term "fibers" or "fibrous material" is further intended to embrance materials which can be used as a means for filtering tobacco smoke in the mouthpieces or filter plugs of cigarettes, cigars, cigarillos and like rod-shaped smokers' articles. The above observations also apply for the fibrous material in the magazine of the part VE2. As a rule, or in many instances, the two fibrous materials will be selected in such a way that the particles at the lighted end of a cigarette consist of high-quality or higher-quality tobacco whereas the particles at the mouthpiece end consist of or contain particles of lower-quality tobacco.

The details of the part VE1 are shown in FIGS. 2 and 2*a*. FIG. 2*a* shows, drawn to a larger scale, the detail Z1 in the left-hand portion of FIG. 2. The part VE1 is or can be identical with the so-called distributor or hopper (known as VE 80) of the aforementioned PROTOS machine.

Referring now to FIGS. 2 and 2*a*, the part VE1 comprises a so-called preliminary or primary distributor 2 having a magazine 1 which receives fibrous material of the first type by way of an intermittently operated gate 3 at the discharge end of a pneumatic conveyor which can receive fibrous material from one or more tobacco shredding machines, not shown. The supply 4 of fibers in the magazine 1 is monitored by a photocell 6 which transmits signals to the motor for the gate 3 when the supply 4 has been depleted to a predetermined extent.

The discharge end of the magazine 1 is adjacent to a rotary star wheel-shaped gate 7 which admits portions of fibers into the magazine 9 to build up the supply 8 whose upper level is monitored by a photocell 11 serving to intermittently operate the gate 7 so as to ensure that the quantity of fibers forming the supply 8 remains at least substantially constant.

The means for withdrawing fibers from the supply 8 in the magazine 9 comprises a series of mobile parts including an endless belt-like elevator conveyor 13 with equidistant entraining elements 12 defining relatively small pockets for advancement of portions of fibrous material along an elongated path terminating at the underside of the aforementioned air-permeable belt conveyor 33 whereon the narrow stream S1 is formed under the action of a suction chamber 48 serving as a means for pneumatically attracting the growing stream and the fully grown stream S1 to the underside of the lower reach of the conveyor 33. The reference character Z1 can be said to denote a stream forming zone wherein the fibers which are withdrawn from the magazine 9 by the entraining elements 12 of the elevator conveyor 13 are converted into successive increments of the narrow stream S1.

The portions of fibrous material which are entrained by the elements 12 of the elevator conveyor 13 are equalized by a rotating paddle wheel 14 whose paddles (e.g., straps made of leather or other flexible material) brush off the surplus and cause the conveyor 13 to dump a succession of substantially identical (equalized) portions of fibers into an upright duct 16 wherein the fibers accumulate into a column 17. The height of the column 17 is monitored by a set of photocells 18 whose signals are used to control the speed of the motor which drives the elevator conveyor 13 in such a way that the height of the column 17 fluctuates within a narrow range.

The lower end portion 19 of the duct 16 is adjacent to a driven carded drum 21 which cooperates with an oscillating smoothing device 22 having a profiled agitating portion. The device 22 ensures that the column 17 descends toward the drum 21 at the rate at which fibers are being removed from the duct 16 as well as that the carding of the drum 21 is uniformly filled with fibrous material. The layer of fibers which is transported by the carding of the drum 21 is expelled by a rapidly rotating picker roller 23 which propels the expelled fibers onto the upper reach of a relatively wide apron conveyor 24. The conveyor 24 is driven at a constant speed and advances the leader of the wide carpet of fibers which accumulates on its upper reach into the range of a classifying device 26 having a row of orifices 27 for jets of compressed air or another gaseous fluid. The jets form a curtain which is traversed by the heavier particles (e.g., by fragments of tobacco ribs) but diverts the lighter particles (such as shreds of tobacco leaf laminae) into a funnel 29. The heavier particles whose trajectories remain substantially unchanged are propelled into an intercepting receptacle 28 containing a feed screw or other suitable means for continuous or intermittent evacuation of heavier particles.

The funnel 29 directs the lighter particles into the range of a rapidly rotating carded drum 31 which propels the particles into the aforementioned duct 32 wherein the particles form the narrow shower 46 whose constituents advance in directions indicated by the arrows 86 (FIG. 3*a*), i.e., at right angles to the direction (arrow A in FIG. 3*a*) of travel of the growing and fully grown stream S1 at the underside of the lower reach of the belt conveyor 33. The showering action of the carded drum 31 is assisted by jets of compressed air which issue from orifices 34 at a level below the duct 32 and impart to the fibrous material a component of movement in the direction indicated by arrows 86.

The upper side of the lower reach of the belt conveyor 33 is ajdacent to the perforated bottom wall 47 of the suction chamber 48. The latter is connected to the intake of a fan 51 by a conduit 49 so as to establish a pressure differential between the two sides of the lower reach of the conveyor 33 and to thus ensure that the fibers which rise in the duct 32 adhere to and travel with the lower reach in the direction of arrow A.

The fully grown narrow stream S1 is trimmed by an adjustable equalizing device 35 (see particularly FIG. 3*a*) which uniformizes the height of the stream so that the inlet of the conduit 71 receives fixed quantities of fibers per unit of time. The surplus 88 which is removed by the cutter or cutters of the equalizing device 35 is caused to descend onto an endless belt conveyor 38 which returns the surplus into the lower portion 37 of the magazine 9 (see the lower right-hand portion of FIG. 2). A metallic or plastic partition 36 is provided in the magazine 9 to separate the bulk of the supply 8 from the contents of the lower portion 37 and to prevent penetration of fibers which form the supply 8 directly into the discharge end of the belt conveyor 38. The belt conveyor 38 can be replaced with a vibratory conveyor or with a pneumatic conveyor without departing from the spirit of the invention.

The aforementioned gate at the discharge end of the casing of the cyclone separator 81 also discharges onto the conveyor 38, i.e., the fibers of the remnant S1R of the stream S1 are returned into the magazine 9 via conveyor 38.

The structure which is shown in FIGS. 2 and 2*a* is similar to that described and shown in commonly owned copending patent application Ser. No. 622,680 filed June 20, 1984 by Werner Hartmann et al.

The equalizing device 35 is of conventional design; it can comprise two driven coplanar trimming discs 87 and a rotary brush or a shred cutting tool (not shown) at a level below the discs 87. Reference may be had to commonly owned U.S. Pat. No. 4,564,028 granted Jan. 14, 1986 to Heitmann.

The trimmed stream S1 advances beyond the equalizing device 35 and leaves the lower reach of the conveyor 33 at the downstream end of the suction chamber 48 to enter the inlet of the pneumatic conduit 71 for transport toward the batch forming station 118 of FIG. 3*b*.

The means for automatically adjusting the position of the equalizing device 35 with reference to the conveyor 33 (and for thus selecting the height of the stream S1) includes a motor 89 which receives signals from a monitoring device 91 serving to scan the stream S1 downstream of the equalizing station and to generate signals which are indicative of the monitored density and/or height of the stream. The monitoring device 91 is known; e.g., it can constitute a so-called NSR detector which is manufactured and sold by the assignee of the present application and operates with a source of corpuscular radiation (e.g., beta rays). The detector ascertains the mass of fibrous material per unit length of the trimmed stream S1 and influences the level of the equalizing device 35 accordingly. The signal which is generated by the monitoring device 91 is preferably compared with a reference signal, and the equalizing device 35 is adjusted (raised or lowered) when the difference between the reference signal and the signal from the monitoring device 91 exceeds a preselected value.

In addition to or in lieu of receiving signals from the monitoring device 91, the motor 89 for the equalizing device 35 can receive signals from a second monitoring device 129 (FIG. 3*b*) which is adjacent to the path of movement of a file of spaced-apart batches A1 at the underside of the lower reach of the belt conveyor 131 and serves to ascertain the density and/or another important parameter of each of the series of batches and to transmit appropriate signals to the motor 89 when the monitored parameter of a batch A1 (or of a series of two or more successive batches A1) deviates from a predetermined optimum value. The construction of the monitoring device 129 may but need not be identical with that of the monitoring device 91. The connection (conductor) between the monitoring device 129 and the motor 89 is shown at 130.

The motor 89 can further receive signals from a third monitoring device 92 which is installed in or adjacent to the conduit 72 and ascertains the quantity of fibrous material forming the remnant or remainder S1R of the stream S1, i.e., the quantity of that fibrous material which is not accepted by the conveyor 76 at the batch forming station 118 and must be returned to the magazine portion 37 via cyclone separator 81 and conveyor 38. Thus, the position of the equalizing device 35 with reference to the belt conveyor 33 can be adjusted, preferably automatically, in response to deviation of one, two or more parameters from selected predetermined values.

The formation of the narrow shower 46 as the last stage of gathering the withdrawn fibers into the stream S1 renders it possible to admit into the duct 32 accurately metered quantities of fibers so that the stream S1 is substantially uniform even before it reaches the equalizing device 35. The combination of the shower forming means 31, 32, 34 with the equalizing device 35 ensures that the inlet of the conduit 71 receives identical quantities of fibers per unit of time.

The conveyor 76 delivers a continuous file of spaced-apart batches Al to the lower reach of the conveyor 131 at the aforementioned transfer station 123 and is installed at one end of a stream forming zone Z2 whose other end is adjacent to the draping device U. The peripheral surface 75 of the conveyor 76 is formed with a series of equidistant elongated recesses or pockets 111 wherein the batches A1 are formed under the action of suction which is created by an air evacuating means in the form of a suction chamber 141 within the confines of the conveyor 76 (hereinafter called wheel). The bottom walls of the pockets 111 are formed with suction ports 139 (see particularly FIGS. 4*b* and 4*c*) which constitute a means for pneumatically drawing fibers into the respective pockets 111 during a certain stage of each revolution of the wheel 76. The suction generating device which draws air from the suction chamber 141 is not specifically shown in the drawing; if desired, the intake of the fan 83 in the cyclone separator 81 or the intake of the fan 51 of FIG. 2*a* can be connected to the outlet of the suction chamber 141.

Figures 4, 4A:
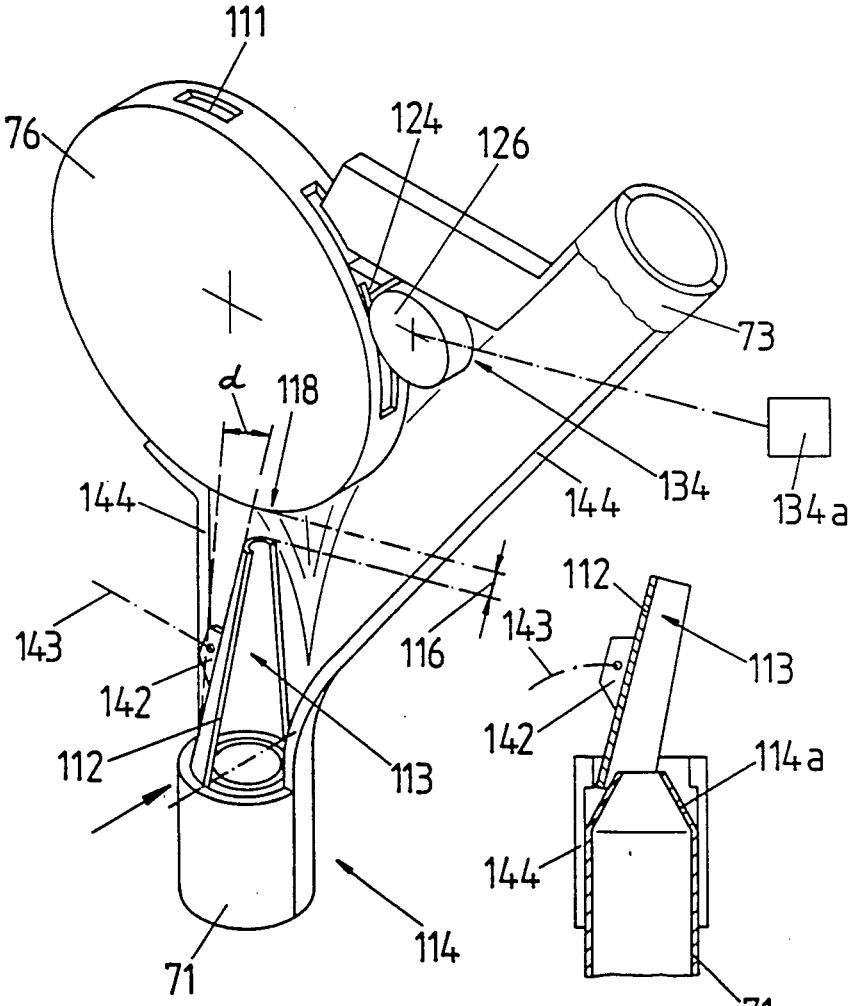
FIG. 4 is a perspective view of the rotary stream converting conveyor and of the adjacent components of means for moving the narrow stream toward as well as for transporting the remnant of such stream away from the batch forming station.
FIG. 4*a* is a sectional view of a detail in FIG. 4.
Figure 5:
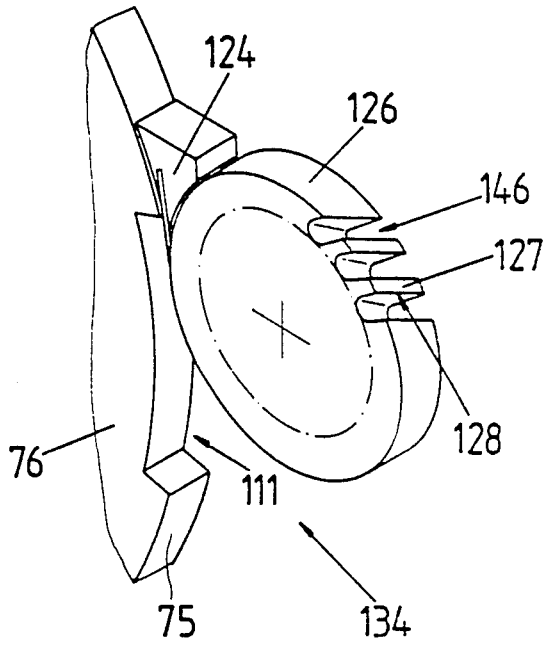
FIG. 5 is a perspective view of the device which trims the batches in the pockets of the stream converting conveyor.

The outlet 114 of the pneumatic conduit 71 is spaced apart from the peripheral surface 75 of the wheel 76 so as to provide room for an adjustable tobacco-guiding wall 112 whose end section 113 is adjacent to but still spaced apart from the peripheral surface 75 (see particularly FIG. 4). The inclination of the guide wall 112 is selected in such a way that successive increments of at least the major portion of the trimmed stream S1 which is caused to advance beyond the outlet 114 of the conduit 71 impinge upon the peripheral surface 75 at a predetermined angle so that the increments of the stream S1 have a component of movement in the direction (arrow B) of rotation of the wheel 76. The direction in which the stream S1 impinges upon the wheel 76 is neither radial nor tangential with reference to the peripheral surface 75. This can be readily seen in FIG. 3*b*. The width of the stream S1 (as considered in the axial direction of the wheel 76) equals or approximates the width of the pockets 111. In FIG. 4, the angle alpha denotes the inclination of the leader of the stream S1 (namely of that portion of the stream S1 which advances along the guide wall 112 and beyond its end section 113) with reference to a plane which extends radially of the wheel 76 and includes the axis of rotation of the wheel. The just discussed inclination of the leader of the stream S1 at the station 118 ensures that fibrous material which is not accepted by the pockets 111 of the wheel 76 do not pile up at the peripheral surface 75 and thus cannot interfere with the formation of batches A1 in successive pockets 111. Moreover, such inclination of the leader of the stream S1 has been found to guarantee the assembly of a long series of identical of practically identical batches A1 which contributes significantly to the quality of the composite stream S2 and of the filler which is obtained as a result of equalizing, homogenizing and draping of the stream S2. A particularly important parameter of the batches A1 is their density; therefore, the aforediscussed monitoring device 129 is adjacent to the transfer station 123 and its signals can influence the position of the trimming or equalizing device 35 for the stream S1 as well as one or more other adjusting means which influence elements that can affect the density of the batches A1.

The inclination of the guide wall 112 (i.e., the angle alpha) and hence the position of the end section 113 with reference to the peripheral surface 75 of the wheel 76) can be adjusted by the monitoring device 129 (through a control unit 132) by way of a motor 136 (e.g., an electromagnet) and an operative connection 143 which is indicated in FIG. 3*b* by a phantom line. The end section 113 of the guide wall 112 has an extension 142 (see FIGS. 4 and 4*a*) which is coupled to the adjusting means (motor 136) by the aforementioned connection 143. The motor 136 can pivot the guide wall 112 in the region of the nozzle-like part **114*a* of the outlet 114 of the conduit 71. The guide wall 112 is mounted between the nozzle-like part 114*a* and a stationary portion 144** of the housing of the apparatus.

The reference character 116 (FIG. 4) denotes the distance between the end section 113 of the pivotable guide wall 112 and the peripheral surface 75 of the wheel 76. As can be seen in FIG. 3*b*, the suction chamber 141 in the wheel 76 extends upstream (through an angle 117) beyond the station 118 (i.e., beyond the locus of impingement of the leader of the trimmed stream S1 against the peripheral surface 75, as considered counter to the direction (arrow B) of rotation of the wheel 76). This ensures that the leader of the stream S1 is flexed (as indicated at 119 in FIG. 3*b*) counter to the direction of rotation of the wheel 76 and into the front or foremost portion of the oncoming pocket 111 to thus ensure an even more reliable filling of the pocket with the fibrous material of the stream S1. Such flexing of the leader of the stream S1 at 119 has been found to contribute significantly to more satisfactory filling of the pockets 111 with fibers and to more satisfactory homogenizing of the developing batches A1.

The stationary portion 144 of the housing of the improved apparatus surrounds the entire batch forming station 118 and connects the outlet of the conduit 71 with the intake end of the conduit 72 so that the non-accepted fibers (i.e., the remainder or remnant S1R of the stream S1) find their way into the conduit 72 and are entrained into the casing of the cyclone separator 81.

Figure 4B:
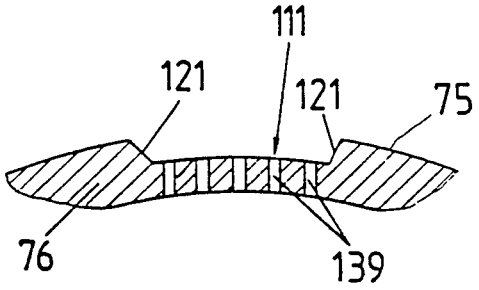
FIG. 4*b* is a fragmentary sectional view of one embodiment of a rotary stream converting conveyor which can be used in the machine of FIG. 1.

FIG. 4*b* shows a portion of the wheel 76 and one of the pockets 111 as well as the suction ports 139 which serve to pneumatically draw fibers into the pocket 111 while the latter travels past the suction chamber 141. The depth of the pocket 111 which is shown in FIG. 4*b* is constant and the mutual inclination of surfaces 121 at the front and rear ends of the pocket 111 (as considered in the direction of rotation of the wheel 76) is selected with a view to promote the penetration of fibers into the pocket while the latter approaches and travels past the batch forming station 118 of FIG. 3*b*. The inclination of each of the two surfaces 121 can be determined empirically to best suit the rated peripheral speed of the wheel 76, the rate of delivery of fibers via conduit 71, the selected inclination of the guide wall 112 relative to the peripheral surface 75 and/or certain other parameters which influence the homogeneousness of batches A1 in the pockets 111.

Figure 4C:
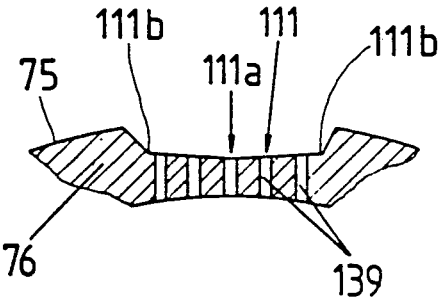
FIG. 4*c* is a similar fragmentary sectional view of a modified stream converting conveyor.

FIG. 4*c* shows a portion of a modified wheel 76 wherein the depth of the median portion 111*a* of the pocket 111 exceeds the depth of the end portions 111*b* of the pocket. Thus, the depth of each pocket 111 in the wheel 76 varies in the circumferential direction of the wheel. The advantages of batches A1 which are thicker in the middle and somewhat thinner at the ends (as seen in the direction of arrow D in FIG. 3*b*) will be pointed out with reference to FIGS. 6 and 7.

The wheel 76 cooperates with an adjustable trimming device 134 which influences a parameter of the batches A1 in successive pockets 111. The parameter is the mass of fibrous material per unit length of the batches. The device 134 is mounted in the housing of the apparatus upstream of the transfer station 123 and comprises a fixedly mounted knife 124 whose cutting edge is adjacent to the peripheral surface 75 of the wheel 76 and a rotary knife 126 having a set of cutters or teeth 127 with cutting edges 128 which are inclined with reference to the axis of the wheel 76 and to a line which is parallel to such axis and contacts the peripheral surface 75. The recesses or tooth spaces 146 between the cutters or teeth 127 of the rotary knife 126 are relatively deep to allow for penetration of separated fibers. The cutting edges 128 cooeerate with the cutting edge of the knife 124 to perform a shearing action which ensures highly accurate equalization of the batches A1 ahead of the transfer station 123. The shearing action of the cutters 127 in cooperation with the fixedly mounted knife 124 ensures that the rotary knife 126 cannot pull fibers out of the pockets 111 which advance past the trimming device 134. The inclination of cutting edges 128 relative to the axis of the wheel 76 ensures that the separated or severed fibers automatically leave the adjacent tooth spaces 146 and enter the intake end of the conduit 72 to be advanced toward and into the casing of the cyclone separator 81.

The position of the trimming device 134 relative to the peripheral surface 75 of the wheel 76 can be altered in response to signals from the monitoring device 129 via control unit 132 and an adjusting element 134*a* (FIG. 3*b*), e.g., a reversible electric motor or the like. Signals from the monitoring device 129 cause the trimming device 134 to change the extent to which it influences a particular parameter (especially mass and/or density) of successive batches A1 before such batches reach the belt conveyor 131.

It has been shown that the aforediscussed inclination of the guide wall 112, namely so that the leader of the stream S1 does not travel radially and/or tangentially of the peripheral surface 75 of the wheel 76, contributes significantly to the formation of satisfactory batches A1 as well as to a reduction of the likelihood of clogging of the station 118 with fibrous material. Clogging of the station 118 not only affects the quality of the batches A1 but also necessitates prolonged stoppages of the apparatus with attendant huge losses in output. The placing of the end section 113 of the guide wall 112 at a predetermined distance (116) from the peripheral surface 75 of the wheel 76 is desirable and advantageous for the aforediscussed reasons, i.e., the leader of the stream S1 can be caused to flex (at 119) counter to the direction of rotation of the wheel 76 while it is being approached by an empty pocket 111 so that fibers which issue from the outlet 114 of the conduit 71 have a longer interval to properly fill the pockets. The selected inclination of the guide wall 112 influences the density of the batches A1, i.e., signals from the monitoring device 129 to the means (136, 143) for adjusting the inclination of the guide wall 112 can bring about an immediate change of the density of successive batches A1.

It is also within the purview of the invention to periodically pivot the guide wall 112 in synchronism with the speed of rotary movement of the wheel 76 so that the end section 113 of the guide wall 112 travels with that pocket 111 which is in the process of receiving successive increments of the stream S1. Such periodic pivoting of the guide wall 112 in and counter to the direction of rotation of the wheel 76 also contributes to more satisfactory filling of the pockets 111 by ensuring that each pocket can receive fibers for a longer interval of time.

The lower reach of the belt conveyor 131 is confined in a tobacco channel 150 which is open from below and which further receives an elongated suction chamber 148 adjacent to the upper side of the lower reach of the conveyor 131. The suction chamber 148 has a perforated bottom wall which extends from the transfer station 123 to the draping device U. The outlet 149 of the suction chamber 148 is connected with a suction generating device, not shown. The conveyor 131 is trained over a set of pulleys 151.

Some fibers are likely to descend from successive batches A1 at the transfer station 123 during transfer of such batches onto the lower reach of the conveyor 131. The thus separated fibers are collected in an upright duct 137 (FIG. 3*b*) which admits the separated fibers into a conduit 138 for delivery directly into the conduit 71 upstream of the batch forming station 118 or for delivery onto the conveyor 38 for transport into the lower portion 37 of the magazine 9.

The wheel 76 surrounds the aforementioned stationary suction chamber 141 as well as a stationary valving element 152 which extends along an arc W in the direction (arrow B) of rotation of the wheel 76 from the transfer station 123 to the batch forming station 118. The valving element 152 has one or more orifices 122 which admit blasts of compressed air into the adjacent pockets 111 while the pockets travel back toward the station 118. The purpose of such compressed air is to expel eventually adhering fibers from the pockets 111 before the pockets reach the leader of the stream S1 at the station 118. The blasts of compressed air are broken up into smaller jets during passage from the orifice or orifices 122 into the adjacent pockets 111 through the ports 139 in the bottom walls of such pockets. Fibers which are expelled from the pockets 111 travelling from the transfer station 123 toward the batch forming station 118 are propelled into the duct 137 and return into the conduit 71 via conduit 138.

The valving element 152 within the confines of the hollow wheel 76 is further provided with one or more additional orifices 153 which admit jets of compressed air into pockets 111 travelling past the transfer station 123. The jets which issue from the orifice or orifices 153 and entering the adjacent pockets 111 via corresponding ports 139 assist in the transfer of successive batches A1 from the wheel 76 onto the conveyor 131. The source or sources of compressed air for admission into the orifices 122 and 153 of the valving element 152 are not shown in the drawing. The batches A1 which reach the underside of the lower reach of the conveyor 131 are attracted to such lower reach by the pressure differential which is established by the suction chamber 148.

The valving element 152 ensures that each pocket 111 is empty not later than when it approaches the station 118. This guarantees that the ports 139 are not clogged with fibers and that the pressure (namely subatmospheric pressure) in each of the pockets 111 which are about to receive fibers matches a desired value as determined by the pressure in the suction chamber 141. Compressed air which issues from the orifice or orifices 122 of the valving element 152 further ensures the expulsion of impurities which could otherwise accumulate in the ports 139 and/or pockets 111.

The provision of means (137, 138) for returning into the conduit 71 those fibers which become separated from the batches A1 at or downstream of the transfer station 123 contributes to more economical operation of the apparatus.

The monitoring device 129 is a differential pressure detector with two sensors 129*a* extending into the suction chamber 148. As mentioned above, the device 129 monitors the density of successive batches A1 and transmits appropriate signals to one or more devices which are adjustable to influence such parameter of the batches A1 in a sense to maintain the parameter at a constant value. The control circuit 132 evaluates the signals from the monitoring device 129 and transmits appropriate signals to the adjusting means 89, 134*a*, 136 and/or to additional adjusting means. As mentioned above, the adjusting means 136 can select the angle (alpha) of inclination of the guide wall 112 relative to the peripheral surface 75 of the wheel 76, the adjusting means 134*a* can select the distance of the knives 124, 126 of the trimming device 134 from the peripheral surface 75, and the adjusting means 89 can select the distance of the trimming or equalizing device 35 from the lower reach of the belt conveyor 33. At the present time, the adjusting action of the adjusting means 89, 134*a* and 136 is preferably such that the density of successive batches A1 on the conveyor 131 will match or closely approximate an optimum value.

Signals from the control means 132 can also be utilized to operate an adjusting device 133 (denoted in FIG. 3*b* by phantom lines) which is used to regulate the pressure in the suction chamber 141 as a function of deviations of the density of batches A1 from an optimum value. Still further, signals which are generated by the monitoring device 129 can be used to influence a device (e.g., an adjustable gate or flow restrictor) which controls the rate of flow of fibers in the conduit 72 and/or the speed of the current of gaseous carrier medium and stream portion S1R in the conduit 72. Signals which are transmitted by the control unit 132 can further influence the speed of the conveyor 33 and/or 131, i.e., the speed of the stream S1 and/or S2. Still further, signals from the monitoring device 129 can be used to adjust the means for rotating and/or for otherwise moving elements of the withdrawing means and/or stream gathering means in the structure which is shown in FIGS. 2, 2*a* and 3*a*.

The aforedescribed monitoring device 129 in the form of a differential pressure detector can be replaced with other types of monitoring devices without departing from the spirit of the invention. For example, the monitoring device 129 can be replaced with a density measuring unit which operates with a source of corpuscular radiation. Details of the monitoring device 129 are described in the aforementioned commonly owned copending patent application Ser. No. 622,680 of Hartmann et al.

The duct 154 in the stream forming zone Z2 shown in FIG. 3*b* supplies a uniform shower of second fibrous material toward the path of movement of the single file of batches Al at the underside of the lower reach of the conveyor 131. Fibrous material which is supplied by the duct 154 fills the gaps 147 between neighboring batches A1 of the file to form accumulations A2 which alternate with the batches A1 of the resulting composite stream S2. The (upper) discharge end of the duct 154 registers with the tobacco channel 150 for the lower reach of the conveyor 131.

It is desirable and advantageous to ensure the establishment of smooth transitions between the longitudinal ends of the batches A1 and the adjacent ends of the accumulations A2. One mode of ensuring the establishment of such smooth transitions has been described with reference to FIG. 4*c*, i.e., by providing the wheel 76 with pockets 111 which are deeper in the middle (at 111*a*) than at the ends (111*b*). This enables a certain quantity of second fibers to overlie the thinner end portions of the neighboring batches A1 and to thus ensure a more satisfactory interlacing of first and second fibers in the aforementioned regions 227. Proper interlacing of first and second fibers in the regions 227 contributes to the stability of the composite stream S2 and hence to the stability of the filler which is obtained as a result of homogenizing and trimming of the stream S2 and to the stability of rod-shaped articles which are formed by the cutoff 54.

The homogenizing device H of FIGS. 3*b* and 6 is located upstream of the equalizing device 211 and includes a rotary disc-shaped compacting or condensing cam 221 with four equidistant peripheral lobes 222 which shift portions of accumulations A2 in a direction toward the underside of the lower reach of the conveyor 131. The manner in which the lobes 222 shift the material of the accumulations A2 can be seen in FIG. 6 which shows that the lobes 222 leave depressions 223 in the regions 227 where the batches A1 abut the adjacent accumulations A2. This eliminates the likelihood of the presence of cavitities or unsatisfactorily densified portions in the stream which advances beyond the homogenizing device H and into the range of the rotary cutting or trimming disc or discs 231 of the equalizing device 211. The resulting filler is compacted and draped in the draping device U so that the web 216 and the filler together constitute a continuous cigarette rod which is subdivided by the cutoff 54 to yield plain cigarettes of desired length. The surplus (212 in FIG. 3*b*) which is removed by the equalizing device 211 is caused to descend along one side of a downwardly sloping baffle 212 and onto an endless belt conveyor 214 which returns the removed surplus to the magazine in the part VE2. The arrangement is preferably such that (contrary to the showing of FIG. 6) the trimming disc or discs 231 of the equalizing device 211 remove only fibrous material of the second type (accumulations A2) in order to ensure that the surplus 212 need not be classified according to fibers prior to returning it into the magazine of the part VE2 and/or into the magazine 9 of the part VE1.

The disc cam 221 of the homogenizing device H is driven by a variable-speed motor 225 (FIG. 3*b*) whose speed is synchronized with the speed of the motor (not shown) for the shaft of the wheel 76 so as to ensure that the rate of delivery of batches A1 onto the conveyor 131 is properly related to the frequency at which the lobes 222 of the disc cam 221 shift the adjacent fibers in a direction toward the conveyor 131 so as to form the aforementioned depressions 223 in the regions 227 where the end portions of the batches Al abut the adjacent accumulations A2. Thus, the peripheral speed of the disc cam 221 (rotating in the direction of arrow 226) must be properly related to the speed of movement of the conveyor 131 in the direction of arrow D in order to ensure that the lobes 222 contact the stream S2 only in the aforediscussed regions 227.

It has been found that the lobes 222 reliably eliminate cavities in the regions 227 to thus ensure the formation of a highly satisfactory rod-like filler. The compacting or condensing and shifting action of the lobes 222 is preferably such that the density of the end portions of the accumulations A2 matches the density of the batches A1.

The pressure in the suction chambers 141 and 148 as well as the rate of delivery of fibers via duct 154 can be readily selected in such a way that the height of the accumulations A2 (as measured at right angles to the direction which is indicated by the arrow D) exceeds the height of the batches A1. This enables the operator to position the equalizing device 211 in such a way that its trimming disc or discs 231 remove only fibers of the second type with the aforediscussed advantages, namely the absence of any need for classification of the surplus 212 according to fibers prior to returning the surplus into the magazine of the part VE2 and/or VE1.

FIG. 7 shows a portion of a modified apparatus wherein the homogenizing device includes a trimming disc 231A and the draping unit U (not shown in FIG. 7). The cutting edge 235 at the periphery of the disc 231A has recesses or pockets 232 which provide the trimmed stream S2 with spaced-apart protuberances 233 in the regions 227, and such protuberances are shifted toward the axis of the filler during subsequet draping of the filler into a web 216 of cigarette paper or the like in the format of the draping device U. An advantage of the combined homogenizing and equalizing device of FIG. 7 is that the disc cam 221 or an analogous discrete compacting of shifting means can be dispensed with because the shifting is effected by the draping device U which follows the disc 231A in the direction of arrow D.

The cutting edge 235 of the disc 231A can be provided with additional recesses or pockets 232 which provide the trimmed stream S2 with additional protuberances 234. Such protuberances disappear during draping in the device U and they provide the filler of the wrapped cigarette rod with uniformly spaced-apart dense protions which are needed for the making of dense-end cigarettes. The knife or knives of the cutoff 54 are then caused to cut across or adjacent to the densified portions (depressed protuberances 234) of the cigarette rod so that at least one end of each cigarette is denser than the intermediate portion of the cigarette.

The reference character 230 denotes a motor or other suitable adjusting means which can move the trimming disc 231 axially toward and away from the conveyor 131 in order to select the quantities of fibrous material which are removed by the cutting edge 235. The motor 230 can receive signals from the monitoring device 129 or from a device which monitors the density of the filler in the cigarette rod.

An important advantage of homogenization of the stream S2 in the regions 227 where the batches A1 abut the accumulations A2 is that the cavities (if any) in the regions 227 are eliminated by mere shifting of the material of the batches A1 and/or accumulations A2, i.e., without the need for admission of additional material for the express purpose of densifying the stream S2 at 227. All that is necessary is to shift some fibrous material (preferably the material of the accumulations A2), either prior to draping or in the course of the draping operation. The homogenizing action can be readily selected and/or adjusted in such a way that the density and/or other desirable parameters of the homogenized stream S2 in the regions 227 match the same parameters of the stream between the ends of the batches A1 and/or accumulations A2. As can be seen in FIGS. 6 and 7, the homogenizing action can precede or it can take place simultaneously with trimming of the stream S2.

The homogenizing device of FIG. 7 exhibits the additional advantage that one and the same trimming disc (231A) can be used to remove the surplus as well as to provide the trimmed stream S2 with additional protuberances 234 which enable the draping device U and the cutoff 54 to convert the web 216 and the stream S2 into cigarettes with dense ends.

Commonly owned U.S. Pat. No. 4,485,826 to Holznagel discloses an apparatus for making fillers wherein a rotary cam compresses spaced-apart portions of a tobacco stream. The purpose of such compacting action is to condense the stream in the regions where the filler of the cigarette rod is severed by the knife or knives of the cutoff.

The improved apparatus is relatively simple in spite of the fact that it is capable of forming and processing batches Al with a heretofore unmatched degree of reliability. The drives for various moving parts can be identical with the drives of conventional machines (e.g., of the aforementioned PROTOS). The utilization of belt conveyors 33 and 131 which cooperate with suction chambers to attract the streams S1 and S2 also contributes to smooth and predictable operation of the apparatus for long intervals of time. Moreover, such mode of transporting the streams S1 and S1 ensures that the conduit 71 receives a continuous stream whose homogeneousness is highly satisfactory and leads to the formation of identical batches A1, and that the homogenizing device H or 231A+U receives a continuous composite stream which can be converted into a high-quality filler.

The aforediscussed means for recovering and returning non-accepted portions of the stream S1 and the fibers which descend into the duct 137 treat the fibers gently so that the dimensions and/or other desirable characteristics of the fibers are not affected during transport from the duct 137 into the conduit 71 and/or from the batch forming station 118 to the magazine 9.

The numerous possibilities of influencing the density of the batches A1 render it possible to maintain such density constant for any desired interval of time as well as to reestablish the desired density in practically immediate response to detection of unsatisfactory density at the station for the sensors 129*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for forming batches from fibers of the tobacco processing industry, especially from particles of tobacco leaves, comprising a pneumatic conduit having an outlet; a source of fibers; means for supplying from said source to said conduit a continuous narrow stream of fibers so that such stream advances toward, through and beyond said outlet; and means for converting at least a portion of the stream into a series of batches adjacent to said outlet, comprising a rotary conveyor having a peripheral surface provided with a series of pockets and means for evacuating air from said pockets, said outlet being positioned to deliver at least the major portion of the stream to successive pockets of said rotary conveyor with a component of movement in the direction of rotation of the rotary conveyor whereby the fibers which enter said pockets accumulate into discrete batches.

2. The apparatus of claim 1, wherein said outlet is spaced apart from said peripheral surface and further comprising guide means for guiding the stream between said outlet and said peripheral surface in a direction intermediate a radial and a tangential direction with reference to said peripheral surface.

3. The apparatus of claim 2, wherein said guide means includes an end section which is spaced apart from said peripheral surface and said evacuating means is effective to evacuate air from successive pockets starting upstream of said end section, as considered in the direction of rotation of said rotary conveyor, so that the leader of the stream advancing beyond said end section is caused to move counter to said direction and to enter the oncoming pocket in said peripheral surface.

4. The apparatus of claim 3, further comprising means for adjusting the position of said end section with reference to said rotary conveyor.

5. The apparatus of claim 1, wherein said pockets are arranged to accept a portion of the stream issuing from said outlet and further comprising means for collecting the non-accepted portion of the stream and means for advancing the batches which are formed in said pockets away from said rotary conveyor along a predetermined path.

6. The apparatus of claim 5, wherein said collecting means comprises a second conduit having an intake end in the region of said outlet and a discharge end, and a suction generating device connected to the discharge end of said second conduit.

7. The apparatus of claim 1, wherein each of said pockets has at least one portion of greater depth and at least one portion of lesser depth.

8. The apparatus of claim 7, wherein each portion of greater depth is located substantially midway between the ends of the respective pocket, as considered in the circumferential direction of said rotary conveyor.

9. The apparatus of claim 1, wherein said rotary conveyor has pairs of mutually inclined surfaces flanking said pockets, the surfaces of each pair being disposed at the upstream and downstream ends of the respective pocket, as considered in the direction of rotation of said rotary conveyor.

10. The apparatus of claim 1, wherein said outlet is disposed at a first station and further comprising means for receiving batches from successive pockets at a second station downstream of said first station, as considered in the direction of rotation of said rotary conveyor, and further comprising means for admitting streams of compressed air into successive pockets downstream of said second station but upstream of said first station.

11. The apparatus of claim 1, wherein said pockets are arranged to accept a portion of the stream and some of the fibers are separated from the batches during evacuation of batches from the respective pockets, and further comprising means for returning to said conduit and to said source the non-accepted portion of the stream and the fibers which are separated from the batches.

12. The apparatus of claim 1, further comprising means for trimming the batches in said pockets downstream of said outlet, as considered in the direction of rotation of said rotary conveyor.

13. The apparatus of claim 12, wherein said trimming means comprises a fixedly mounted knife adjacent to the path of movement of pockets and a rotary knife having cutting edges cooperating with said fixedly mounted knife to shear the surplus of fibers from the batches in successive pockets.

14. The apparatus of claim 13, wherein said cutting edges are inclined with reference to the axis of said rotary conveyor.

15. The apparatus of claim 1, further comprising adjustable means for influencing a parameter of the batches, signal generating means for monitoring said parameter of the batches, and means for adjusting said influencing means in response to signals from said monitoring means when the monitored parameter deviates from a predetermined value.

16. The apparatus of claim 15, wherein said parameter is the density of the batches.

17. The apparatus of claim 1, further comprising signal generating means for monitoring a parameter of the batches and means for adjusting said evacuating means in response to signals from said monitoring means when the monitored parameter deviates from a predetermined value.

18. The apparatus of claim 1, further comprising signal generating means for monitoring a parameter of the batches and means for adjusting said supplying means in response to signals from said monitoring means when the monitored parameter deviates from a predetermined value.

19. The apparatus of claim 1, further comprising adjustable means for trimming the batches in said pockets, signal generating means for monitoring a parameter of the batches, and means for adjusting said trimming means in response to signals from said monitoring means when the monitored parameter deviates from a predetermined value.

20. The apparatus of claim 1, further comprising adjustable guide means for guiding the stream intermediate said outlet and said peripheral surface, signal generating means for monitoring a parameter of the batches, and means for adjusting said guide means in response to signals from said monitoring means when the monitored parameter deviates from a predetermined value.

21. The apparatus of claim 1, wherein said supplying means comprises a second conveyor arranged to deliver into said conduit metered quantities of fibers per unit of time.

22. The apparatus of claim 21, wherein said supplying means further comprises means for transferring fibers from said source onto said second conveyor so as to form said stream.

23. The apparatus of claim 22, wherein said second conveyor is arranged to advance the stream in a predetermined direction and said transferring means includes means for showering fibers onto said second conveyor transversely of said direction.

24. The apparatus of claim 22, further comprising adjustable means for equalizing the stream on said second conveyor.

25. The apparatus of claim 1, further comprising means for advancing batches from successive pockets along a predetermined path wherein the batches form a file with gaps between successive batches of the file, means for admitting second fibers into said gaps so as to form on said advancing means a composite stream wherein the batches alternate with accumulations of second fibers, and means for homogenizing the composite stream, at least on the regions where the batches abut the accumulations of second fibers.

26. The apparatus of claim 25, wherein said homogenizing means comprises means for compacting the composite stream in said regions.

27. The apparatus of claim 26, further comprising means for equalizing the homogenized composite stream.

28. The apparatus of claim 25, further comprising combined homogenizing and equalizing means for the composite stream.

29. The apparatus of claim 28, wherein said combined homogenizing and equalizing means comprises a rotary trimming device having means for leaving on the composite stream a protuberance in each of said regions, said homogenizing means further comprising means for draping the trimmed composite stream into a web of wrapping material to form a rod wherein the composite stream constitutes a rod-shaped filler which is devoid of protuberances and is surrounded by the wrapping material.

* * * * *